US011124212B2

(12) United States Patent
Moennich

(10) Patent No.: US 11,124,212 B2
(45) Date of Patent: Sep. 21, 2021

(54) METHOD FOR OPERATING A POSITIONING DEVICE, AND POSITIONING DEVICE

(71) Applicant: SIEMENS MOBILITY GMBH, Munich (DE)

(72) Inventor: Hans-Joerg Moennich, Braunschweig (DE)

(73) Assignee: Siemens Mobility GmbH, Munich (DE)

( * ) Notice: Subject to any disclaimer, the term of this patent is extended or adjusted under 35 U.S.C. 154(b) by 366 days.

(21) Appl. No.: 16/311,274

(22) PCT Filed: Jun. 1, 2017

(86) PCT No.: PCT/EP2017/063259

§ 371 (c)(1),
(2) Date: Dec. 19, 2018

(87) PCT Pub. No.: WO2017/220304

PCT Pub. Date: Dec. 28, 2017

(65) Prior Publication Data

US 2019/0232990 A1 Aug. 1, 2019

(30) Foreign Application Priority Data

Jun. 20, 2016 (DE) ..... 10 2016 210 968.5

(51) Int. Cl.
*B61L 25/02* (2006.01)
*B61L 23/04* (2006.01)

(52) U.S. Cl.
CPC ..... *B61L 25/025* (2013.01); *B61L 23/042* (2013.01)

(58) Field of Classification Search
CPC ..... B61L 25/00; B61L 25/02; B61L 25/025
See application file for complete search history.

(56) References Cited

U.S. PATENT DOCUMENTS 5,330,136 A * 7/1994 Colbaugh ..... B61L 1/06 246/122 R
5,446,452 A * 8/1995 Litton ..... B61K 9/04 246/159

(Continued)

FOREIGN PATENT DOCUMENTS

CN 104943710 A 9/2015
DE 102012213487 A1 2/2014

(Continued)

OTHER PUBLICATIONS

Max Schubert et al, "Fiber Optic Sensing im Eisenbahnsektor", SIGNAL + DRAHT, DVV, (Sep. 1, 2015), vol. 107, No. 9, pp. 42-46, XP001595881—English abstract on p. 46.

(Continued)

*Primary Examiner* — Jason C Smith
(74) *Attorney, Agent, or Firm* — Laurence A. Greenberg; Werner H. Stemer; Ralph E. Locher

(57) ABSTRACT

A method operates a positioning device which has at least one waveguide laid along a route for positioning a track-bound vehicle on the route. Accordingly, the method proceeds in such a way that measurement data related to the track-bound vehicle are captured by a route-side sensor device. An electromagnetic pulse is fed into the waveguide and a backscatter pattern produced by backscattering of the electromagnetic pulse is detected and is subjected to an evaluation. A vehicle-specific characteristic value determined in the evaluation is verified on the basis of the captured measurement data and, if the verification of the at least one vehicle-specific characteristic value is successful, a positioning signal based on the evaluation of the at least one backscatter pattern and indicating the position of the track-bound vehicle is provided by the positioning device.

18 Claims, 1 Drawing Sheet

(56) References Cited

U.S. PATENT DOCUMENTS

| | | | | |
|---|---|---|---|---|
| 5,462,244 | A * | 10/1995 | Van Der Hoek | B61L 1/06 246/122 R |
| 8,985,523 | B2 * | 3/2015 | Chadwick | B61L 25/025 246/167 R |
| 9,457,819 | B2 | 10/2016 | Ernst et al. | |
| 9,566,988 | B2 | 2/2017 | Ernst | |
| 2002/0084387 | A1 * | 7/2002 | Matheson | B61L 17/00 246/124 |
| 2003/0236598 | A1 * | 12/2003 | Villarreal Antelo | B61L 27/0022 701/19 |
| 2007/0150129 | A1 * | 6/2007 | Davenport | B61L 17/00 701/19 |
| 2007/0276555 | A1 * | 11/2007 | Kiss | B61L 25/04 701/19 |
| 2012/0153089 | A1 * | 6/2012 | Galm | B61L 25/025 246/122 R |
| 2014/0362668 | A1 * | 12/2014 | McEwen-King | G01S 1/753 367/118 |
| 2015/0013465 | A1 | 1/2015 | Godfrey | |
| 2015/0166087 | A1 * | 6/2015 | Ernst | B61L 1/165 246/122 R |
| 2015/0251674 | A1 * | 9/2015 | Benkert | B61L 25/02 246/122 R |
| 2015/0274182 | A1 * | 10/2015 | Arpaci | B61L 25/02 246/63 R |
| 2015/0321682 | A1 * | 11/2015 | Ernst | G01S 17/06 356/73.1 |
| 2019/0232990 | A1 * | 8/2019 | Moennich | B61L 25/025 |

FOREIGN PATENT DOCUMENTS

| | | | |
|---|---|---|---|
| DE | 102012217620 | A1 | 3/2014 |
| DE | 102012222471 | A1 | 6/2014 |
| EP | 2817604 | B1 | 5/2018 |
| WO | 2011027166 | A1 | 3/2011 |
| WO | 2013114135 | A2 | 8/2013 |
| WO | 2014019886 | A2 | 2/2014 |
| WO | 2014086582 | A2 | 6/2014 |

OTHER PUBLICATIONS

Mirabadi, A. et al.: "Application of Sensor Fusion to Railway Systems", Proceedings of the 1996 IEEE/SICE/RSJ International Conference on Multisensor Fusion and Integration for Intelligent Systems, Conference Paper—Jan. 1997.

List of Attendees, "Wheel Detection Forum 2015"; https://www.wdfvienna.com/wdf-2015/; 2015.

Optasense:; "OptaSense Commercial and Technical Offer" Aug. 27, 2013.

Albrecht. Thomas et al.: "A Precise and Reliable Train Positioning System and its Use for Automation of Train Operation"; 2013 IEEE International Conference on Intelligent Rail Transportation (ICIRT).

Hall, Andrew: "Declaration in Lieu of an Oath", Feb. 12, 2021.

Maschek, Ulrich: "Sicherung des Semi-independent" [Securing rail traffic] ; Springer Verlag; 2012; English abstract.

Grimm, Matthias et al.: "Anforderungen an eine sicherheitsrelevante Ortung im Schienenverkehr" [Requirements for a safety-relevant location in rail traffic], 20. Verkehrswissenschaftliche Tage Dresden; Sep. 19, 2005-Sep. 20, 2005—English abstract.

Schubert, Max et al:; "Fiber Optic Sensing im Eisenbahnsektor"; Signal + Draht; vol. 107; Sep. 2015—English abstract on p. 6.

Schubert, Max: "Fiber Optic Sensing" (Screenshot), Wheel Detection Forum 2015; Vienna Sep. 30, 2015.

Berlin, Eugen et al:; "Sensor Networks for Railway Monitoring: Detecting Trains from their Distributed Vibration Footprints"; 2013 IEEE International Conference on Distributed Computing in Sensor Systems.

European Union: "Auftragsbekanntmachung" [Contract announcement], Publication of the supplements to the Official Journal, Feb. 24, 2014.

European Union: "Bekanntmachung vergebener Auftraege—Versogungssektoren" [Announcement of the contract awarded], Publication of the supplements to the Official Journal, Jan. 15, 2013.

Durazo-Cardenas, I. et al.: "Precise vehicle location as a fundamental parameter for intelligent self-aware rail-track maintenance systems"; 3rd International Conference on Through-life Engineering Services; Procedia CIRP 22 (2014) 219-224.

DB Mobillity Networks Logistic: "Anschreiben OptaSense" [OptaSense letter], Mar. 6, 2013.

DB: "Richtlinie Deutsche Bahn AG: Zugnummemmeldeanlagen planen"; [Guidelines Deutsche Bahn AG] 2013.

Schubert, Max: "Fiber Optic Sensing"; Signal & Draht Kongress 2015; Nov. 6, 2015.

DB Mobillity Networks Logistic: "Lastenheft Deutsche Bahn AG für Zugnummernmeldeanlagen"; [Specification 415.9202; 2009.

DB Netze AG: "Pilotanlage Lichtwellenleiter—Sensorsystem (fibre optic sensing)", [Pilot plant requirement description]; Draft 2012; 2012.

Peng, Fei et al.: "Real-Time Position and Speed Monitoring of Trains Using Phase-Sensititve OTDR"; IEEE Photonics Technology Letters; vol. 26; No. 20; Oct. 15, 2014.

Pachl, Jörn: "Systemtechnik des Schienenverkehrs" [System technology of rail transport]; 7. Edition; 2013—English abstract.

Schubert, Max: "Faseroptische Sensorsysteme im Bahnumfeld: Chancen und Herausforderungen Ein Erfahrungsbericht aus 18 Monaten Test und Entwicklung auf der Strecke Fulda—Würzburg" [Fibre-optic sensor systems in the railway environment: Considering chances and challenges a field report about 18 months testing and development on the Fulda-Würzburg routeMax Schubert] Abstract; Signal & Draht Kongress 2015; 2015.

Schubert, Max: "Eidesstättige Erklärung" "Declaration in Lieu of an Oath", Feb. 12, 2021.

Rosenberger, Martin et al.: "Distributed Acoustic Sensing als Basistechnologie für Anwendungen im Bahnbereich" [Distributed Acoustic Sensing as a base technology for railway applications]; Signal + Draht; vol. 108; Sep. 2016; German/English version.

Wei, Chu-Liang et al: "A fiber Bragg grating sensor system for train axle counting"; IEEE Sensors Journal; vol. 10; No. 12; pp. 1905-1912; 2010.

"Vertrag—Lichtwellenleiter—Sensorsystem TEI-M-T/12/359377" [Contract for the construction of a pilot plant], 2013.

DB Netze AG: "Pilotanlage Lichtwellenleiter—Sensorsystem (fibre optic sensing)"—[Pilot plant milestone plan—LWL-Sensorsystem (fibre optic sensing)]; Draft 2012; Dec. 25, 2012.

DB Netze AG: "Pilotanlage Lichtwellenleiter—Sensorsystem (fibre optic sensing)" [Pilot plant requirement description—Fibre optic sensing]; Draft 2013; Jul. 3, 2013.

* cited by examiner

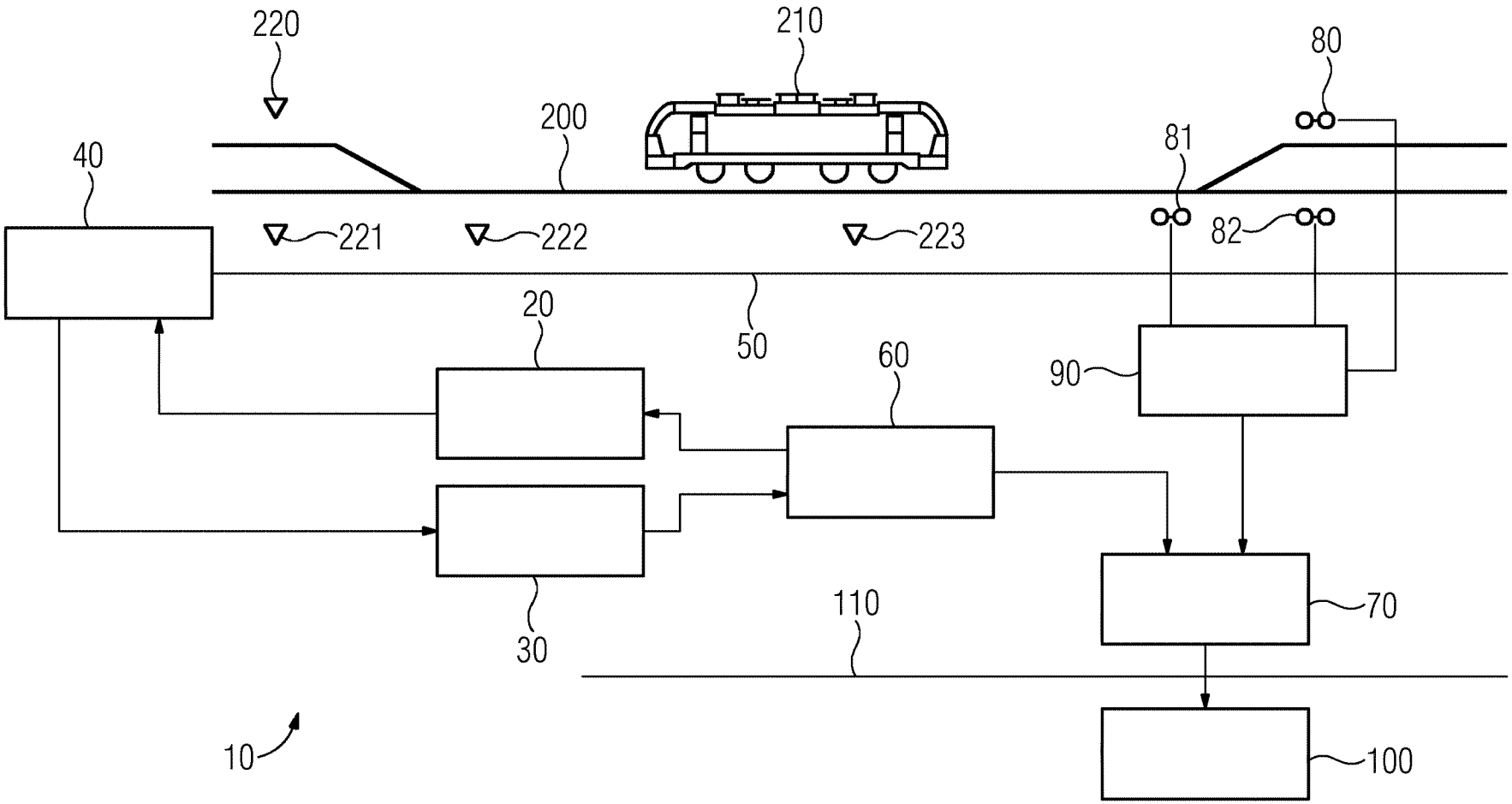
80
81
82
90
70
100
210
223
60
110
50
200
222
20
30
220
221
40
10

METHOD FOR OPERATING A POSITIONING DEVICE, AND POSITIONING DEVICE

BACKGROUND OF THE INVENTION

Field of the Invention

For safe operation of track-bound vehicles, which may be for example rail vehicles, track-guided vehicles with rubber tires, or magnetic levitation trains, reliable information relating to the respective location or position of the vehicles operated in the respective system is of fundamental importance.

International patent application WO 2011/027166 A1 discloses a method for locating a rail vehicle, in which, for the purpose of locating the rail vehicle on a line section in the form of a track section, a waveguide laid along the track section is provided. Electromagnetic pulses are supplied to the waveguide one after the other. For each emitted pulse, in each case at least one backscatter pattern, produced by backscattering of the electromagnetic pulse, is received and evaluated. By evaluating the backscatter patterns, it is possible to locate the respective rail vehicle on the track section. The technology used is also known as fiber sensing or distributed acoustic sensing. However, the corresponding known systems have the disadvantage that, as such, they do not typically have reliable signaling—that is to say that they do not satisfy the particularly demanding safety requirements applicable to use in the sector of rail safety engineering. This has the result that corresponding systems are not suitable or approved for use in safety-critical, "vital" applications, as exemplified for example by route securing or control of vehicles by a train control system.

SUMMARY OF THE INVENTION

The object of the present invention is to specify a method that is relatively simple to realize and at the same time particularly powerful and that satisfies demanding safety requirements, for operating a locating device that, for the purpose of locating a track-bound vehicle on a line section, includes at least one waveguide that is laid along the line section.

According to the invention, this object is achieved by a method for operating a locating device that, for the purpose of locating a track-bound vehicle on a line section, includes at least one waveguide that is laid along the line section, wherein measurement data relating to the respective track-bound vehicle is detected by a trackside sensor device, at least one electromagnetic pulse is supplied to the waveguide, at least one backscatter pattern, produced by backscattering of the at least one electromagnetic pulse, is detected and undergoes an evaluation, at least one vehicle-specific parameter that was determined in the course of the evaluation is verified using the detected measurement data, and, in the event of a successful verification of the at least one vehicle-specific parameter by the locating device, a location signal that specifies the location of the track-bound vehicle on the basis of the evaluation is provided.

The method according to the invention for operating a locating device that, for the purpose of locating a track-bound vehicle on a line section, includes at least one waveguide that is laid along the line section is initially characterized in that measurement data relating to the respective track-bound vehicle is detected by a trackside sensor device. The trackside sensor device is a component that is independent of the waveguide and components associated therewith—that is to say, of the fiber sensing system. Preferably here, the trackside sensor device satisfies demanding safety requirements, so that the detected measurement data can be considered trustworthy.

According to the following two steps of the method according to the invention, in a manner known per se at least one electromagnetic pulse is supplied to the waveguide and then at least one backscatter pattern, produced by backscattering of the at least one electromagnetic pulse, is detected and undergoes an evaluation. Corresponding fiber sensing systems that are suitable for this are known per se and are available from various manufacturers.

According to the next step of the method according to the invention, at least one vehicle-specific parameter that was determined in the course of the evaluation is verified using the detected measurement data. Here, the verification may for example be performed by a comparison of the at least one vehicle-specific parameter and the detected measurement data or at least part thereof. Depending on the type of mutually compared parameter or parameters, here complete agreement, in the sense of being identical, may be required for a successful verification, or alternatively a tolerance range is permitted in the context of the comparison. Independently of this, using the detected measurement data as a reference gives a result or provides a check of whether the at least one vehicle-specific parameter (where appropriate with a sufficiently high level of probability for the respective application) is correct—that is to say corresponds to reality, or not.

According to the last step of the method according to the invention, in the event of a successful verification of the at least one vehicle-specific parameter by the locating device, a location signal that specifies the respective location of the track-bound vehicle on the basis of the evaluation of the at least one backscatter pattern is provided. This means that the location signal that is based on the evaluation of the at least one backscatter pattern—that is to say on the information of the fiber sensing system—and specifies the respective location of the track-bound vehicle is provided only if a successful verification of the evaluation result based on the detected backscatter patterns has been performed using the measurement data detected using the trackside sensor device. If the reverse is true, the result is that if the at least one vehicle-specific parameter is not in agreement with the measurement data detected using the trackside sensor device, there is no confidence in the result of the evaluation of the backscatter patterns, and so no location signal based on this evaluation is provided. If a corresponding location signal has already been produced, it is rejected or alternatively is identified as not trustworthy.

The method according to the invention has the advantage that, using the measurement data detected by the trackside sensor device, it allows correct functioning of the fiber sensing system to be checked independently. In the event of a successful check, this gives the possibility of classifying as trustworthy the measurement values detected by the light waveguide as the sensor, or the result of evaluation thereof. Assuming that there is corresponding reliability of the detection of the measurement data by the trackside sensor device and of the procedure of verifying the at least one vehicle-specific parameter using the detected measurement data, this opens up the possibility of using the location signal based on evaluation of the at least one backscatter pattern for safety-relevant applications as well, such as a "track clear" message or train control. On the one hand, this provides the advantage that the location signal based on evaluation of the at least one backscatter pattern typically has very good resolution, so that determining the position of the respective track-bound vehicle can be performed for example to a level of accuracy in the order of magnitude of 5 to 10 m. Moreover, line sections of track-bound vehicles are frequently already laid with waveguides, for example in the form of light waveguides, or such can be laid with relatively little work, as a result of which the work and cost of the installation and operation of other trackside components can be avoided.

In the context of the present invention, the track-bound vehicle may be a track-bound vehicle of any desired type. An example of this is a locomotive having one or more coupled passenger cars or freight cars. As an alternative thereto, the track-bound vehicle may for example also take the form of a multiple unit, in which case it may include in each case one or more driven and/or non-driven vehicles or cars. Furthermore, the track-bound vehicle may also comprise for example one or more freight cars that move, driven by gravity, along a gravity classification yard.

Preferably, the method according to the invention may be developed such that the measurement data is detected by the trackside sensor device when the track-bound vehicle enters a section area that is associated with the locating device, while the track-bound vehicle remains in the section area the detected measurement data is used to verify the respectively determined at least one vehicle-specific parameter, and, every time there is a successful verification of the at least one vehicle-specific parameter, the location signal is provided by the locating device. This embodiment of the method according to the invention has the advantage that the measurement data is detected by the trackside sensor device when the track-bound vehicle concerned enters the section area associated with the locating device, and this measurement data is then used, over the entire succeeding period during which the track-bound vehicle remains in the section area concerned, to verify or check the at least one vehicle-specific parameter that was determined in the course of the evaluation of the at least one backscatter pattern. This presupposes that the detected measurement data relates to a measurement parameter or a plurality of measurement parameters that does/do not change, or only in a predictable manner, while the track-bound vehicle remains in the section area. Hence, it therefore becomes possible to use the trackside sensor device to perform a verification of the at least one vehicle-specific parameter over a potentially very long section area. Consequently, further trackside sensor devices are not required in the section area associated with the locating device. As a result of a corresponding one-time detection of the measurement data, considerable costs and work can thus be avoided.

According to a further particularly preferred embodiment of the method according to the invention, the measurement data detected by the trackside sensor device includes at least one of the following measurement parameters: location of the track-bound vehicle, speed of the track-bound vehicle, vehicle length of the track-bound vehicle, number of axles of the track-bound vehicle. This is advantageous, because the measurement parameters mentioned are of the type that can conventionally be determined by evaluating detected backscatter patterns using fiber sensing systems. In particular, the vehicle length of the track-bound vehicle and the number of axles of the track-bound vehicle, as measurement parameters, furthermore have the advantage here that they should be invariable over time when the track-bound vehicle is in operation, with the result that the measurement parameters concerned are also suitable as reference or comparison parameters at a later point.

Preferably, the method according to the invention may also be developed such that the measurement data is detected by a trackside sensor device with reliable signaling. The use of a trackside sensor device with reliable signaling is advantageous, since a sensor device of this kind is guaranteed to satisfy the demanding safety requirements of rail signaling technology. Thus, this is also true of the measurement data detected by a trackside sensor device with reliable signaling of this kind, and as a result it is particularly suitable as a reference or comparison measure for the at least one vehicle-specific parameter determined on the basis of the backscatter patterns. Depending on the respective requirements and conditions, as a result of the comparison the results of the evaluation of the fiber sensing system may also be classified as having reliable signaling, and as a result the fiber sensing system may also be used for safety-relevant applications.

In principle, the trackside sensor device may be any desired type of sensor device that is known per se. This includes for example cameras or light barriers, and other systems known per se for determining speed, vehicle length and/or the number of axles of the respective track-bound vehicle.

According to a further particularly preferred embodiment of the method according to the invention, the measurement data is detected by a trackside sensor device in the form of an axle counter. This is advantageous because axle counters are extremely reliable sensor devices that are widely used in the sector of rail signaling technology and typically provide reliable signaling. Using an axle counter of this kind, which is substantially a two-channel wheel sensor, and an axle counting evaluation device, where appropriate arranged at a spacing from the actual sensor, it is possible to determine the number of axles of the track-bound vehicle. Moreover, a corresponding axle counter can determine the speed of each axle of the track-bound vehicle and, on the basis of the speed and the period during which the axle counter is occupied, from the first axle until the last axle is detected, can calculate the length of the track-bound vehicle. At the same time, as a result of detecting the track-bound vehicle, the location thereof at the time of detection is also detected, which in this case corresponds to the location of the axle counter. The use of an axle counter as a trackside sensor device is also advantageous in that axle counters are frequently already installed along the line sections of track-bound vehicles. As a result, an axle counter of this kind that is present in any case may advantageously be used in the context of operation of the locating device.

Preferably, the method according to the invention may also be developed such that the at least one vehicle-specific parameter that is determined is monitored over time, and the location signal is provided if the time characteristic of the at least one vehicle-specific parameter is judged to be plausible. Monitoring the at least one determined vehicle-specific parameter over time advantageously makes a further check test or plausibility check of the vehicle-specific parameter possible. Thus, when the vehicle length or the number of axles is used as the vehicle-specific parameter, it is possible to check that this remains constant as would be expected. Furthermore, when the speed of the track-bound vehicle is used as the vehicle-specific parameter, it is possible to check that there are no implausible changes in speed. In this context, the acceleration and braking capability of track-bound vehicles is itself known and can thus be taken into account in the plausibility check. With other vehicle-specific parameters too, if the fiber sensing system is functioning correctly it will typically be expected that these parameters do not undergo any step changes or the like over time. In this way, monitoring the at least one determined vehicle-specific parameter over time provides another way of performing a plausibility check of the data that is detected using the waveguide as a sensor. In this case, the location signal is only provided if the time characteristic of the at least one vehicle-specific parameter is judged to be plausible. If this is not the case, advantageously a corresponding error message is output, and a location signal, which may already have been generated, is rejected or identified as erroneous or dubious.

Preferably, the method according to the invention may also take a form such that the locating device receives vehicle data specific to the respective track-bound vehicle, from a control device of a train control system, the received vehicle data is used by the locating device in the context of a check test or plausibility check of the at least one vehicle-specific parameter, and the location signal is provided by the locating device in the event of a successful check test or plausibility check. Corresponding vehicle data may be for example the length or the number of axles of the track-bound vehicle, or indeed the braking capability thereof. In respect of the length or the number of axles of the track-bound vehicle, a direct comparison with the corresponding vehicle-specific parameter is possible here. In contrast thereto, the braking capability may be used to evaluate the plausibility of a vehicle-specific parameter in the form of the speed of the vehicle. In this case too, the location signal is only output if, in the course of the comparison or evaluation, agreement or consistency is found between the vehicle data and the at least one vehicle-specific parameter. As a result of this, there is therefore a further way of performing a consistency check of the data or results supplied by the fiber sensing system.

According to a further particularly preferred embodiment of the method according to the invention, an acoustic transmitter arranged on the line section is used to generate a test signal specific to this acoustic transmitter, and on the basis of the test signal a function check of the locating device is performed. The acoustic transmitter is thus in this context a component that generates a test signal specific to this acoustic transmitter, in the form of an acoustic signal or a vibration. Since the test signal is a signal that is generated at a known location and where appropriate at a known point in time and has a known form, it becomes possible to perform a function check of the locating device on the basis of the test signal. Here, the acoustic transmitter may generate a corresponding test signal at regular intervals in time and/or on request by a higher-level monitoring component. Because the test signal is specific to the respective acoustic transmitter, advantageously the possibility of crosstalk of the test signal and thus an erroneous status message is eliminated. This means that on the basis of the test signal, which may have for example a specific or projected bit pattern, it is possible to check unambiguously that this test signal has actually been generated by the acoustic transmitter arranged on the line section. This is thus significant in particular where a plurality of light waveguides and/or a plurality of acoustic transmitters is arranged in the area of the line section.

In principle, the location signal that is provided in the event of positive verification may be used for any desired purpose. This includes in particular applications in the realm of a "track clear" message and of train control or train protection.

According to a further particularly preferred embodiment of the method according to the invention, the provided location signal is used for a clear or occupied message of virtual clear message sections that are projected in the locating device. This embodiment of the method according to the invention has the advantage that for corresponding virtual clear message sections their length or granularity can be defined or projected in accordance with the respective requirements. By utilizing the provided location signal for a clear or occupied message of corresponding virtual clear message sections, which do not therefore correspond to any physical clear message sections delimited by corresponding devices on the line section, it is possible for the locating device advantageously to generate and output an item of information that is similar to those known track clear message systems using axle counters or track circuits, for example. In this way, the corresponding item of information on whether the track is occupied may be transmitted for example to a switch tower, which then takes account of it when securing the route. If the virtual clear message sections are selected to be sufficiently small, an approximation to moving block operation is possible. As an alternative thereto, it goes without saying that the provided location signal may also be used in an actual moving block operation and hence for example in conjunction with the corresponding train control systems in local transport or with ETCS (European train control system) level 3.

Moreover, the present invention relates to a locating device.

As regards the locating device, the object of the present invention is to specify a locating device that is relatively simple to realize and at the same time particularly powerful and that satisfies demanding safety requirements, and that, for the purpose of locating a track-bound vehicle on a line section, includes at least one waveguide that is laid along the line section.

According to the invention, this object is achieved by a locating device having at least one waveguide that is laid along a line section of a track-bound vehicle, a trackside sensor device for detecting measurement data relating to the respective track-bound vehicle, a pulse generating device for generating and supplying electromagnetic pulses to the waveguide, a detection device for detecting backscatter patterns produced by backscattering of the electromagnetic pulses, and an evaluation device for evaluating the detected backscatter patterns, wherein the locating device is embodied to verify at least one vehicle-specific parameter that was determined in the course of the evaluation, using the detected measurement data, and, in the event of a successful verification of the at least one vehicle-specific parameter, to provide a location signal that specifies the respective location of the track-bound vehicle on the basis of the evaluation of the at least one backscatter pattern.

The advantages of the locating device according to the invention correspond substantially to those of the method according to the invention, so that in this respect the reader is referred to the corresponding statements above. The same applies correspondingly to the preferred developments that are mentioned below of the locating device according to the invention, as regards the corresponding preferred developments of the method according to the invention, so that in this respect too the reader is referred to the respective explanations above.

According to a particularly preferred development, the locating device according to the invention is embodied to store measurement data that is detected by the trackside sensor device when the track-bound vehicle enters a section area associated with the locating device, to use the stored measurement data while the track-bound vehicle remains in the section area for verifying the respectively determined at least one vehicle-specific parameter, and, every time there is a successful verification of the at least one vehicle-specific parameter, to provide the location signal.

Preferably, the locating device according to the invention may also be embodied such that the trackside sensor device is embodied to detect measurement data including at least one of the following measurement parameters: location of the track-bound vehicle, speed of the track-bound vehicle, vehicle length of the track-bound vehicle, number of axles of the track-bound vehicle.

According to a further particularly preferred embodiment of the locating device according to the invention, the trackside sensor device is a trackside sensor device with reliable signaling.

According to another particularly preferred embodiment of the locating device according to the invention, it is an axle counter.

Preferably, the locating device according to the invention may also be developed such that the locating device is embodied to monitor the at least one determined vehicle-specific parameter over time, and to provide the location signal if the time characteristic of the at least one vehicle-specific parameter is judged to be plausible.

Preferably, the locating device according to the invention may also be developed such that the locating device has a receiving device for receiving vehicle data specific to the respective track-bound vehicle, from a control device of a train control system, and is embodied to use the received vehicle data in the context of a check test or plausibility check of the at least one vehicle-specific parameter, and to provide the location signal in the event of a successful check test or plausibility check.

According to a further particularly preferred embodiment of the locating device according to the invention, the locating device includes at least one acoustic transmitter arranged on the line section and embodied to generate a test signal specific to this acoustic transmitter, wherein the locating device is embodied to perform a function check of the locating device on the basis of the test signal.

According to a particularly preferred embodiment, the locating device according to the invention is embodied to use the provided location signal for a clear or occupied message of virtual clear message sections that are projected in the locating device.

BRIEF DESCRIPTION OF THE SEVERAL VIEWS OF THE DRAWING

The invention will be explained in more detail below with reference to exemplary embodiments. Here:

The FIGURE shows in a schematic sketch, for the purpose of explaining an exemplary embodiment of the method according to the invention, an arrangement having an exemplary embodiment of the locating device according to the invention.

DESCRIPTION OF THE INVENTION

The FIGURE shows a locating device 10 that includes a pulse generating device 20, a detection device 30, a coupling device 40, a waveguide 50, an evaluation device 60, a safe location processor 70, trackside sensor devices 80, 81 and 82, and an axle counting processor 90.

Preferably, the pulse generating device 20 has a laser (not shown in more detail) that makes it possible to generate short electromagnetic, in particular optical, pulses regularly, for example at a fixedly predetermined pulse rate, and to supply them to the waveguide 50 by way of the coupling device 40. Here, the pulse generating device 20 is preferably controlled by the evaluation device 60, with the result that the points in time at which the pulses are generated are at least approximately known to the evaluation device 60.

The detection device 30 has for example a photodetector that enables detection of electromagnetic radiation. The detection device 30 transmits its measured signals to the evaluation device 60, which evaluates them. The pulse generating device 20, the detection device 30, the coupling device 40, the waveguide 50, and the evaluation device 60 thus form a sensor system that is conventionally designated a fiber sensing or distributed acoustic sensing system, and which is known per se and commercially available.

It can be seen in the FIGURE that the waveguide 50 is arranged along a line section 200. A track-bound vehicle 210 in the form of a rail vehicle travels on the line section 200. Here, it is assumed that the track-bound vehicle 210 is moving from right to left in the illustrated exemplary embodiment.

In the context of the described exemplary embodiment, the trackside sensor devices 80, 81 and 82 take the form of axle counters, it being assumed that they are in a form with reliable signaling—that is to say that they satisfy the demanding safety requirements of rail signaling technology. In accordance with the illustration in the FIGURE, the trackside sensor devices 80, 81, 82 are coupled in communication with the axle counting processor 90, which for its part, like the evaluation device 60, is in communicating connection with the safe location processor 70. Here, the location processor 70 is "safe" in that it takes a form with reliable signaling and hence satisfies the demanding safety requirements of rail safety engineering.

It should be noted that, in accordance with the exemplary embodiments described below, the trackside sensor device 80 is already in itself sufficient, so that the trackside sensor devices 81 and 82 could in principle be dispensed with.

At this point it should further be pointed out that the communication connections indicated in the FIGURE by the corresponding lines may be embodied for unidirectional or indeed bidirectional communication. Where corresponding arrows indicate a corresponding direction, this serves merely to illustrate the flow of communication and signals that is relevant in the context of describing the exemplary embodiments of the present invention, so in particular does not exclude the possibility of bidirectional communication between the components concerned as well.

The safe location processor 70 is for its part coupled in communication with a switch tower 100. Here, the task of the safe location processor 70 is in particular to transmit a location signal with reliable signaling to the switch tower 100. At the switch tower 100, this location signal, or the item of locating information therein, is taken into account in securing a route of the track-bound vehicle 210 and other track-bound vehicles traveling on the line section 200.

The safe location processor 70 and the switch tower 100 are furthermore in communicating connection by way of a communication interface 110 with safe location processors that are associated with neighboring section areas.

The locating device 10 illustrated in the FIGURE can be operated for example such that measurement data relating to the track-bound vehicle 210 is detected, or in the situation shown in the FIGURE has been detected, for example by the trackside sensor device 81 when the track-bound vehicle 210 enters a section area that is associated with the locating device 10 and, in the exemplary embodiment of the FIGURE, stretches from the trackside sensor device 81 to the location of the coupling device 40. A corresponding section area could for example correspond to the distance between two stations and hence have a length for example in the range between 10 km and 40 km, depending on the respective circumstances.

It is assumed that the trackside sensor device 81 and the axle counting processor 90, which may also be considered jointly as a corresponding sensor device, have detected measurement data that includes as parameters a speed, vehicle length and number of axles of the track-bound vehicle 210. Moreover, a further parameter is provided in that the track-bound vehicle 210 has reached the location of the trackside sensor device 81 at the point in time at which the trackside sensor device 81 detects the first axle thereof. It should be pointed out that as an alternative thereto the trackside sensor device 81 may also be able to detect only one or more of the parameters mentioned.

Using the pulse generating device 20, at least one electromagnetic pulse is subsequently supplied by way of the coupling device 40 to the waveguide 50, which in the context of the described exemplary embodiment is assumed to be a light waveguide. Then, at least one backscatter pattern that is produced by backscattering of the at least one electromagnetic pulse is detected by the detection device 30 and undergoes an evaluation by the evaluation device 60. Here, as a result of an appropriate modulation triggered by the vibration caused by the track-bound vehicle 210, it is possible for the evaluation device 60 to detect the presence of the track-bound vehicle 210 on the line section 200. Taking into account the transit time of the supplied electromagnetic pulse inside the waveguide 50 and the backscatter pattern produced by backscattering, the evaluation device 60 is furthermore enabled to determine the position of the track-bound vehicle 210. Here, currently commercially available systems achieve resolutions in the range from typically approximately 5-10 m, so that the position of the track-bound vehicle 210 can be determined with a relatively high level of accuracy. However, corresponding fiber sensing systems do not conventionally satisfy the demanding requirements made of rail signaling technology in respect of their signaling reliability. This has the result that the location of the rail vehicle 210 that is determined using the light waveguide 50 cannot be used without further measures for safety-critical applications, such as in conjunction with a "track clear" message for securing the route, or in conjunction with a train control system.

So that the corresponding information can also be made usable for safety-relevant applications, or indeed so that the safety and reliability of the system can be enhanced for other applications as well, the at least one vehicle-specific parameter that is determined in the context of evaluation by the evaluation device 60 is verified by the safe location processor 70 using the measurement data that is detected by the trackside sensor device 81 and transmitted by, or by way of, the axle counting processor 90 to the safe location processor 70. At least at the point in time at which the track-bound vehicle 210 enters the section area concerned—that is to say has just reached the trackside sensor device 81—there may be used here as the vehicle-specific parameter for example the location of the track-bound vehicle 210 or the speed of the track-bound vehicle 210.

Using the fiber sensing system, it is moreover also possible to determine the length and the number of axles of the track-bound vehicle 210 as a vehicle-specific parameter. Because these values may also be determined using the measurement data that is detected by the trackside sensor device 81, these parameters may likewise be used for verifying the at least one vehicle-specific parameter using the measurement data. Moreover, the vehicle length and the number of axles provide the advantage that these parameters should not vary as the track-bound vehicle 210 travels through the section area. Consequently, the corresponding measurement data is still available as a comparison reference for verifying the vehicle-specific parameter(s) once the track-bound vehicle 210 has gone beyond the trackside sensor device 81. Hence, it advantageously becomes possible for the at least one vehicle-specific parameter that is determined by the fiber sensing system and is transmitted thereby, together with a determined location of the track-bound vehicle 210, to the safe location processor 70 to be verified over a relatively long period, even if it does not pass further trackside sensor devices. In this context, a corresponding verification may be performed for example by a corresponding comparison between the detected measurement data and the at least one vehicle-specific parameter that is determined in the context of the evaluation, wherein the verification is successful, depending on the respective vehicle-specific parameter, if the corresponding values match one another, in the sense of being identical or alternatively within a tolerance range.

As a result of a corresponding verification of the data or information supplied by the fiber sensing system, it is now advantageously possible for the safe location processor 70 to identify the information concerned, or the fiber sensing system as such, as trustworthy and hence as the supplier of a reliable item of location information with reliable signaling in dependence on the respective requirements and conditions. Hence, this provides the advantage that the locating device 10 or the safe location processor 70 thereof provides or outputs a location signal that is based on the evaluation of the at least one backscatter pattern, is determined by the evaluation device 60 and transmitted to the safe location processor 70, and specifies the respective location of the track-bound vehicle 210, and this location signal can thus also be used for applications having requirements in respect of the safety or reliability of the information. If by contrast the verification is not successful, then the locating device 10 does not provide a location signal, or an already generated location signal is rejected or identified as not trustworthy.

It should be pointed out that advantageously the trackside sensor devices 81, 82, 82 are not, at least in respect of the section area concerned, an independent "track clear" message system. Thus, the trackside sensor device 81 merely serves to detect the corresponding measurement data initially or once, when the relevant section area is entered. This measurement data can then be used without the need for further trackside sensor devices for this purpose.

In addition to the verification described above, there is moreover also the possibility that the evaluation device 60 will monitor the at least one vehicle-specific parameter over time and that the location signal will be provided if the time characteristic of the at least one vehicle-specific parameter is judged to be plausible. Conversely, this means that the location signal is not provided or is rejected if unexpected changes occur over time in the at least one vehicle-specific parameter. These may be for example changes in the number of axles or the train length, or implausible changes in speed or unexpected step changes over time.

Furthermore, it is also possible for vehicle data specific to the track-bound vehicle 210 to be received by the locating device 10 from a control device of a train control system, and for this received vehicle data to be used by the locating device 10 or the safe location processor 70 thereof for a further plausibility check or check test of the at least one vehicle-specific parameter. Here, the received specific vehicle data may be for example the vehicle length of the track-bound vehicle 210 or the braking capability thereof. While the braking capability may be used for example in the context of a plausibility check of changes in speed, the number of axles or the vehicle length may be used directly for a corresponding comparison with a corresponding vehicle-specific parameter. Thus, where appropriate a further check of functioning of the fiber sensing system is possible using the vehicle data received from the control device of the train control system, wherein the location signal is, in this case too, output by the locating device 10 only if the comparison establishes an agreement or consistency between the vehicle data and the at least one vehicle-specific parameter.

Advantageously, a further functional check of the locating device 10 is possible using an acoustic transmitter (not illustrated in the FIGURE, for reasons of clarity) that is arranged on the line section 200. If the acoustic transmitter generates a test signal specific thereto, this test signal may be used on the one hand to check functioning of the detection device 30, the coupling device 40, the waveguide 50 and the evaluation device 60. Here, a corresponding coding of the test signal, specific to the respective acoustic transmitter, eliminates the possibility of signal crosstalk and ensures that the received test signal does in fact come from the associated acoustic transmitter.

The location signal provided by the safe location processor 70 of the locating device 10 may advantageously be used for a clear or occupied message from clear message sections that are projected in the locating device 10. These virtual clear message sections are delimited by clear message points, indicated in the FIGURE by the reference numeral 220, 221, 222 and 223. This means that, after the above-mentioned comparisons and consistency checks have been performed, the location processor 70 having reliable signaling transmits to the switch tower 100 clear or occupied messages in respect of these virtual clear message sections. Here, the position of the virtual clear message points 220, 221, 222, 223 or the length of the clear message sections formed thereby may advantageously be selected in accordance with the requirements and needs of each case.

In accordance with the statements above in conjunction with the described exemplary embodiments of the method according to the invention and the locating device according to the invention, in particular these have the advantage that they make it possible to utilize location or position information that is delivered by a fiber sensing system also for applications for which the safety provided by the system concerned as such is not sufficient, as regards the reliability of the information. Advantageously here, it is only necessary to detect sensor data that is independent of the fiber sensing system once, and this sensor data can then be used repeatedly to verify the fiber sensing system. If the verification is performed in accordance with the exemplary embodiments described above by a location processor 70 with reliable signaling, and the trackside sensor device 81 that is used also has reliable signaling, this has the result that the reliability of the fiber sensing system can be checked in a reliable manner, and this system or the location signal output thereby can be approved as having reliable signaling, where appropriate simply because of its incorporation in the locating device 10. The fiber sensing system is thus advantageously also usable for applications having demanding requirements in respect of the safety of the information provided, as a result of which new application possibilities are opened up in the area of rail signaling technology.

The invention claimed is:

1. A method for operating a locating device for locating a track-bound vehicle on a line section and includes at least one waveguide that is laid along the line section, which comprises the steps of:

detecting measurement data relating to the track-bound vehicle by a trackside sensor device;

supplying at least one electromagnetic pulse to the waveguide;

detecting at least one backscatter pattern, produced by backscattering of the at least one electromagnetic pulse, and evaluating the backscatter pattern;

verifying at least one vehicle-specific parameter that was determined in a course of an evaluation using the measurement data detected; and providing a location signal specifying a respective location of the track-bound vehicle on a basis of the evaluation of the at least one backscatter pattern in an event of a successful verification of the at least one vehicle-specific parameter by the locating device.

2. The method according to claim 1, which further comprises:

detecting the measurement data by the trackside sensor device when the track-bound vehicle enters a section area that is associated with the locating device;

using the measurement data detected to verify the at least one vehicle-specific parameter while the track-bound vehicle remains in the section area; and providing, every time there is the successful verification of the at least one vehicle-specific parameter, the location signal by the locating device.

3. The method according to claim 1, wherein the measurement data detected by the trackside sensor device includes at least one of the following measurement parameters:

location of the track-bound vehicle;

speed of the track-bound vehicle;

vehicle length of the track-bound vehicle; and number of axles of the track-bound vehicle.

4. The method according to claim 1, which further comprises detecting the measurement data by the trackside sensor device with reliable signaling.

5. The method according to claim 1, which further comprises detecting the measurement data by the trackside sensor device which is in a form of an axle counter.

6. The method according to claim 1, which further comprises:

monitoring over time the at least one vehicle-specific parameter that is determined; and providing the location signal if a time characteristic of the at least one vehicle-specific parameter is judged to be plausible.

7. The method according to claim 1, which further comprises:

receiving, by the locating device, vehicle data specific to the track-bound vehicle, from a control device of a train control system;

using the vehicle data received by the locating device in a context of a check test or plausibility check of the at least one vehicle-specific parameter; and providing, the location signal, by the locating device in an event of a successful check test or a successful plausibility check.

8. The method according to claim 1, which further comprises:

disposing an acoustic transmitter on the line section and the acoustic transmitter is used to generate a test signal specific to the acoustic transmitter; and performing on a basis of the test signal a function check of the locating device.

9. The method according to claim 1, which further comprises using the location signal for a clear or occupied message of virtual clear message sections that are projected in the locating device.

10. A locating device, comprising:

at least one waveguide laid along a line section for a track-bound vehicle;

a trackside sensor device for detecting measurement data relating to the track-bound vehicle;

a pulse generating device for generating and supplying electromagnetic pulses to said waveguide;

a detection device for detecting backscatter patterns produced by backscattering of the electromagnetic pulses;

an evaluation device for evaluating the backscatter patterns detected; and the locating device is embodied to verify at least one vehicle-specific parameter that was determined in a course of an evaluation, using the measurement data detected, and in an event of a successful verification of the at least one vehicle-specific parameter, to provide a location signal that specifies a respective location of the track-bound vehicle on a basis of an evaluation of the at least one backscatter pattern.

11. The locating device according to claim 10, wherein the locating device is embodied:

to store the measurement data that is detected by said trackside sensor device when the track-bound vehicle enters a section area associated with the locating device;

to use stored measurement data while the track-bound vehicle remains in the section area for verifying a respectively determined at least one vehicle-specific parameter; and every time there is a successful verification of the at least one vehicle-specific parameter, to provide the location signal.

12. The locating device according to claim 10, wherein said trackside sensor device is embodied to detect the measurement data including at least one of the following measurement parameters:

a location of the track-bound vehicle;

a speed of the track-bound vehicle;

a vehicle length of the track-bound vehicle;

a number of axles of the track-bound vehicle.

13. The locating device according to claim 10, wherein said trackside sensor device is a trackside sensor device with reliable signaling.

14. The locating device according to claim 10, wherein said trackside sensor device is an axle counter.

15. The locating device according to claim 10, wherein the locating device is embodied to:

monitor the at least one determined vehicle-specific parameter over time; and provide the location signal if a time characteristic of the at least one vehicle-specific parameter is judged to be plausible.

16. The locating device according to claim 10, further comprising a receiving device for receiving vehicle data specific to the track-bound vehicle, from a control device of a train control system, and is embodied to use the vehicle data in a context of a check test or plausibility check of the at least one vehicle-specific parameter, and to provide the location signal in an event of a successful check test or a successful plausibility check.

17. The locating device according to claim 10, further comprising at least one acoustic transmitter disposed on the line section and embodied to generate a test signal specific to said acoustic transmitter, and the locating device is embodied to perform a function check of the locating device on a basis of the test signal.

18. The locating device according to claim 10, wherein the locating device is embodied to use the location signal for a clear or occupied message of virtual clear message sections that are projected in the locating device.

* * * * *